US009080277B2

(12) United States Patent
Erickson et al.

(10) Patent No.: US 9,080,277 B2
(45) Date of Patent: Jul. 14, 2015

(54) APPARATUS AND METHOD FOR DETERMINING INERTIA OF A LAUNDRY LOAD

(71) Applicant: Whirlpool Corporation, Benton Harbor, MI (US)

(72) Inventors: Donald E. Erickson, Stevensville, MI (US); Peter E. Zasowski, Yantis, TX (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 13/633,169

(22) Filed: Oct. 2, 2012

(65) Prior Publication Data

US 2013/0160498 A1 Jun. 27, 2013

Related U.S. Application Data

(60) Provisional application No. 61/578,935, filed on Dec. 22, 2011.

(51) Int. Cl.
*D06F 37/20* (2006.01)
*D06F 39/00* (2006.01)

(52) U.S. Cl.
CPC ..... *D06F 37/203* (2013.01); *D06F 39/003* (2013.01); *D06F 2202/10* (2013.01); *D06F 2202/12* (2013.01)

(58) Field of Classification Search
CPC .. D06F 37/203; D06F 39/003; D06F 2202/12
USPC ..... 68/12.02
See application file for complete search history.

(56) References Cited

U.S. PATENT DOCUMENTS

| | | | | |
|---|---|---|---|---|
| 4,607,408 | A | 8/1986 | Didier et al. | |
| 7,162,759 | B2 | 1/2007 | Weinmann | |
| 7,296,445 | B2 | 11/2007 | Zhang et al. | |
| 2004/0154350 | A1 * | 8/2004 | Weinmann | 68/12.04 |
| 2004/0211009 | A1 * | 10/2004 | Murray et al. | 8/159 |
| 2005/0016226 | A1 | 1/2005 | Okazaki et al. | |
| 2005/0204482 | A1 * | 9/2005 | Murray et al. | 8/158 |

(Continued)

FOREIGN PATENT DOCUMENTS

| | | | |
|---|---|---|---|
| DE | 4431846 | A1 | 3/1996 |
| EP | 0345120 | B1 | 2/1993 |

(Continued)

OTHER PUBLICATIONS

European Search Report for Corresponding EP 12197684.9, Apr. 29, 2013.

*Primary Examiner* — Michael Barr
*Assistant Examiner* — Levon J Shahinian

(57) ABSTRACT

A laundry treating appliance for treating a laundry load according to at least one cycle of operation including a rotatable drum at least partially defining a treating chamber in which a laundry load is received for treatment, a motor rotatably driving the drum in response to a motor control signal, and a controller outputting a motor control signal to rotate the drum according to a speed profile having at least a constant speed phase, where the drum is rotated at a constant speed, and an acceleration phase, where the drum is accelerated to the constant speed and a method of operating a laundry treating appliance to determine an inertia of the laundry load.

20 Claims, 4 Drawing Sheets

(56) References Cited

U.S. PATENT DOCUMENTS

| | | | | |
|---|---|---|---|---|
| 2006/0242768 | A1* | 11/2006 | Zhang et al. | 8/159 |
| 2011/0023602 | A1 | 2/2011 | Altinier et al. | |

FOREIGN PATENT DOCUMENTS

| | | | |
|---|---|---|---|
| EP | 2397600 | A2 | 12/2011 |
| WO | 2006040412 | A1 | 4/2006 |

* cited by examiner

APPARATUS AND METHOD FOR DETERMINING INERTIA OF A LAUNDRY LOAD

CROSS REFERENCE TO RELATED APPLICATIONS

The present application claims the benefit of U.S. Provisional Patent Application No. 61/578,935, filed Dec. 22, 2011, which is incorporated herein by reference in its entirety.

BACKGROUND OF THE INVENTION

Laundry treating appliances, such as a washing machine, may include a drum defining a treating chamber for receiving and treating a laundry load according to a cycle of operation. The cycle of operation may include a phase during which the liquid may be removed from the laundry load, an example of which is an extraction phase where a drum holding the laundry rotates at speeds high enough to impart a sufficient centrifugal force on the laundry load to remove the liquid. During the extraction phase, the laundry load is satellized by centrifugal force and rotates with the drum and exerts a force on the drum.

The extraction phase typically includes multiples of an acceleration phase (ramp) followed by a constant speed phase (plateau), which step the rotational speed up to a final speed plateau. During each plateau, an out of balance test may be run to determine the amount of imbalance of the laundry load. Each plateau is also used in combination with the subsequent ramp to determine the combined inertia of the rotating components of the appliance, like the drum, and the laundry load. The amount of imbalance and/or inertia may be used in setting the rotational speed for subsequent plateaus and/or acceleration rates for subsequent ramps during the extraction phase.

BRIEF DESCRIPTION OF THE INVENTION

In one embodiment, a method of operating a laundry treating appliance having a rotatable drum at least partially defining a treating chamber in which a laundry load is received for treatment, and a motor rotatably driving the drum in response to a control signal, the method including rotating the drum with the motor according to a speed profile having at least a constant speed phase, where the drum is rotated at a constant speed, and an acceleration phase, where the drum is accelerated to the constant speed, monitoring the power provided to the motor during the acceleration phase, calculating the power provided to the motor at the constant speed based on the monitored power during the acceleration phase, determining the power provided to the motor during the constant speed phase, and determining an inertia of the laundry load based on the calculated power and the determined power.

DESCRIPTION OF EMBODIMENTS OF THE INVENTION

Figure 1:
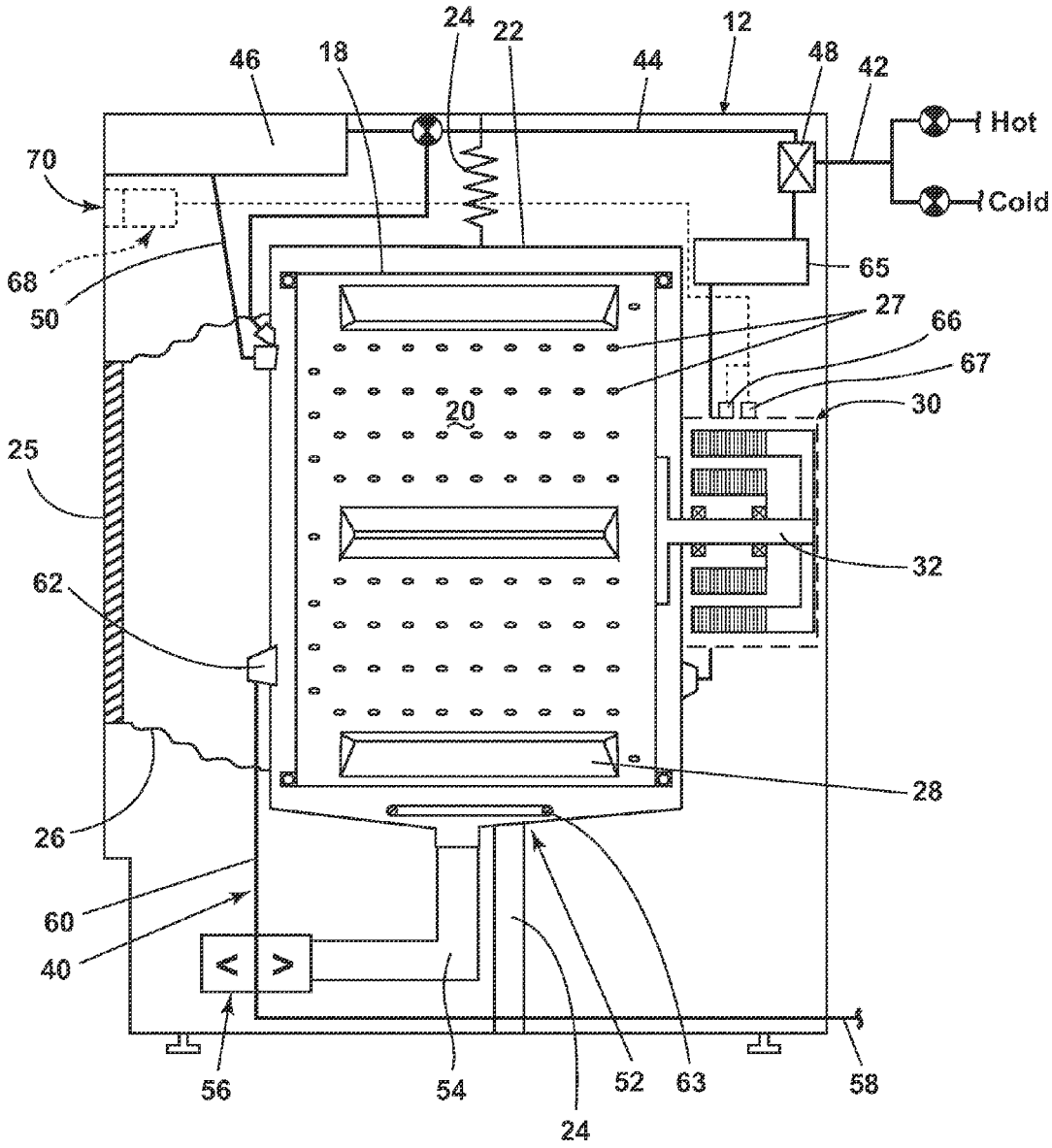
FIG. 1 is a schematic, cross-sectional view of a laundry treating appliance in the form of a washing machine according to one embodiment of the invention.

FIG. 1 is a schematic view of a laundry treating appliance in the form of a horizontal axis washing machine 10 according to one embodiment of the invention. While the laundry treating appliance is illustrated as a horizontal axis washing machine 10, it may be contemplated that the laundry treating appliance may be any appliance which treats laundry such as clothing or fabrics. Non-limiting examples of the laundry treating appliance may include a front loading/horizontal axis washing machine; a top loading/vertical axis washing machine; a combination washing machine and dryer; an automatic dryer; a tumbling or stationary refreshing/revitalizing machine; an extractor; a non-aqueous washing apparatus; and a revitalizing machine. The washing machine 10 described herein shares many features of a traditional automatic washing machine, which will not be described in detail except as necessary for a complete understanding of the invention.

Washing machines are typically categorized as either a vertical axis washing machine or a horizontal axis washing machine. As used herein, the "vertical axis" washing machine refers to a washing machine having a rotatable drum, perforate or imperforate, that holds fabric items and a fabric moving element, such as an agitator, impeller, nutator, and the like, that induces movement of the fabric items to impart mechanical energy to the fabric articles for cleaning action. In some vertical axis washing machines, the drum rotates about a vertical axis generally perpendicular to a surface that supports the washing machine. However, the rotational axis need not be vertical. The drum may rotate about an axis inclined relative to the vertical axis. As used herein, the "horizontal axis" washing machine refers to a washing machine having a rotatable drum, perforate or imperforate, that holds fabric items and washes the fabric items by the fabric items rubbing against one another as the drum rotates. In horizontal axis washing machines, the clothes are lifted by the rotating drum and then fall in response to gravity to form a tumbling action that imparts the mechanical energy to the fabric articles. In some horizontal axis washing machines, the drum rotates about a horizontal axis generally parallel to a surface that supports the washing machine. However, the rotational axis need not be horizontal. The drum may rotate about an axis inclined relative to the horizontal axis. Vertical axis and horizontal axis machines are best differentiated by the manner in which they impart mechanical energy to the fabric articles. In vertical axis machines, a clothes mover, such as an agitator, auger, impeller, to name a few, moves within a drum to impart mechanical energy directly to the clothes or indirectly through wash liquid in the drum. The clothes mover may typically be moved in a reciprocating rotational movement. The illustrated exemplary washing machine of FIG. 1 is a horizontal axis washing machine.

The washing machine 10 may have a housing 12, which may be a frame to which decorative panels are mounted. A rotatable drum 18 may be disposed within an interior of the housing 12 and may at least partially define a treating chamber 20 for treating laundry. The rotatable drum 18 may be mounted within an imperforate tub 22, which may be suspended within the housing 12 by a resilient suspension system 24. Both the tub 22 and the drum 18 may be selectively closed by a door 25. A bellows 26 couples an open face of the tub 22 with the housing 12, and the door 25 seals against the bellows 26 when the door 25 closes the tub 22. The drum 18 may include a plurality of perforations 27, such that liquid may flow between the tub 22 and the drum 18 through the perforations 27. The drum 18 may further include a plurality of baffles 28 disposed on an inner surface of the drum 18 to lift fabric items forming a laundry load contained in the laundry treating chamber 20 while the drum 18 rotates. A motor 30 may be coupled with the drum 18 through a drive shaft 32 for selective rotation of the treating chamber 20 during a cycle of operation. It may also be within the scope of the invention for the motor 30 to be coupled with the drive shaft 32 through a drive belt for selective rotation of the treating chamber 20. The motor 30 may rotate the drum 18 at multiple or variable speeds in either rotational direction.

While the illustrated washing machine 10 includes both the tub 22 and the drum 18, with the drum 18 defining the laundry treating chamber 20, it is within the scope of the invention for the washing machine 10 to include only one receptacle, with the receptacle defining the laundry treating chamber for receiving a laundry load to be treated.

A liquid supply and recirculation system 40 may also be included in the washing machine 10. Liquid, such as water, may be supplied to the washing machine 10 from a water supply 42, such as a household water supply. A supply conduit 44 may fluidly couple the water supply 42 to the tub 22 and a treating chemistry dispenser 46. The supply conduit 44 may be provided with an inlet valve 48 for controlling the flow of liquid from the water supply 42 through the supply conduit 44 to the treating chemistry dispenser 46. The treating chemistry dispenser 46 may be a single-use dispenser, that stores and dispenses a single dose of treating chemistry and must be refilled for each cycle of operation, or a multiple-use dispenser, also referred to as a bulk dispenser, that stores and dispenses multiple doses of treating chemistry over multiple executions of a cycle of operation.

A liquid conduit 50 may fluidly couple the treating chemistry dispenser 46 with the tub 22. The liquid conduit 50 may couple with the tub 22 at any suitable location on the tub 22 and is shown as being coupled with a front wall of the tub 22 for exemplary purposes. The liquid that flows from the treating chemistry dispenser 46 through the liquid conduit 50 to the tub 22 typically enters a space between the tub 22 and the drum 18 and may flow by gravity to a sump 52 formed in part by a lower portion of the tub 22. The sump 52 may also be formed by a sump conduit 54 that may fluidly couple the lower portion of the tub 22 to a pump 56. The pump 56 may direct fluid to a drain conduit 58, which may drain the liquid from the washing machine 10, or to a recirculation conduit 60, which may terminate at a recirculation inlet 62. The recirculation inlet 62 may direct the liquid from the recirculation conduit 60 into the drum 18. The recirculation inlet 62 may introduce the liquid into the drum 18 in any suitable manner, such as by spraying, dripping, or providing a steady flow of the liquid. While the recirculation inlet 62 is illustrated as being located at a lower portion of the tub 22 it is contemplated that it may be located in alternative locations including an upper portion of tub 22.

Additionally, the liquid supply and recirculation system 40 may differ from the configuration illustrated, such as by inclusion of other valves, conduits, wash aid dispensers, heaters, sensors, such as water level sensors and temperature sensors, and the like, to control the flow of treating liquid through the washing machine 10 and for the introduction of more than one type of detergent/wash aid. Further, the liquid supply and recirculation system 40 need not include the recirculation portion of the system or may include other types of recirculation systems.

A heater, such as a sump heater 63 or a steam generator 65, may be provided for heating the liquid and/or the laundry load. The sump heater 63 is illustrated as a resistive heating element. The sump heater 63 may be used alone or in combination with the steam generator 65 to heat the liquid and/or the laundry load.

A controller 68 may be located within the housing 12 for controlling the operation of the washing machine 10 to implement one or more cycles of operation, which may be stored in a memory of the controller 68. Examples, without limitation, of cycles of operation include: wash, heavy duty wash, delicate wash, quick wash, refresh, rinse only, and timed wash. A user interface 70 may also be included on the housing 12 and may include one or more knobs, switches, displays, and the like for communicating with the user, such as to receive input and provide output. The user may enter many different types of information, including, without limitation, cycle selection and cycle parameters, such as cycle options. Any suitable cycle may be used. Non-limiting examples include, Heavy Duty, Normal, Delicates, Rinse and Spin, Sanitize, and Bio-Film Clean Out.

Figure 2:
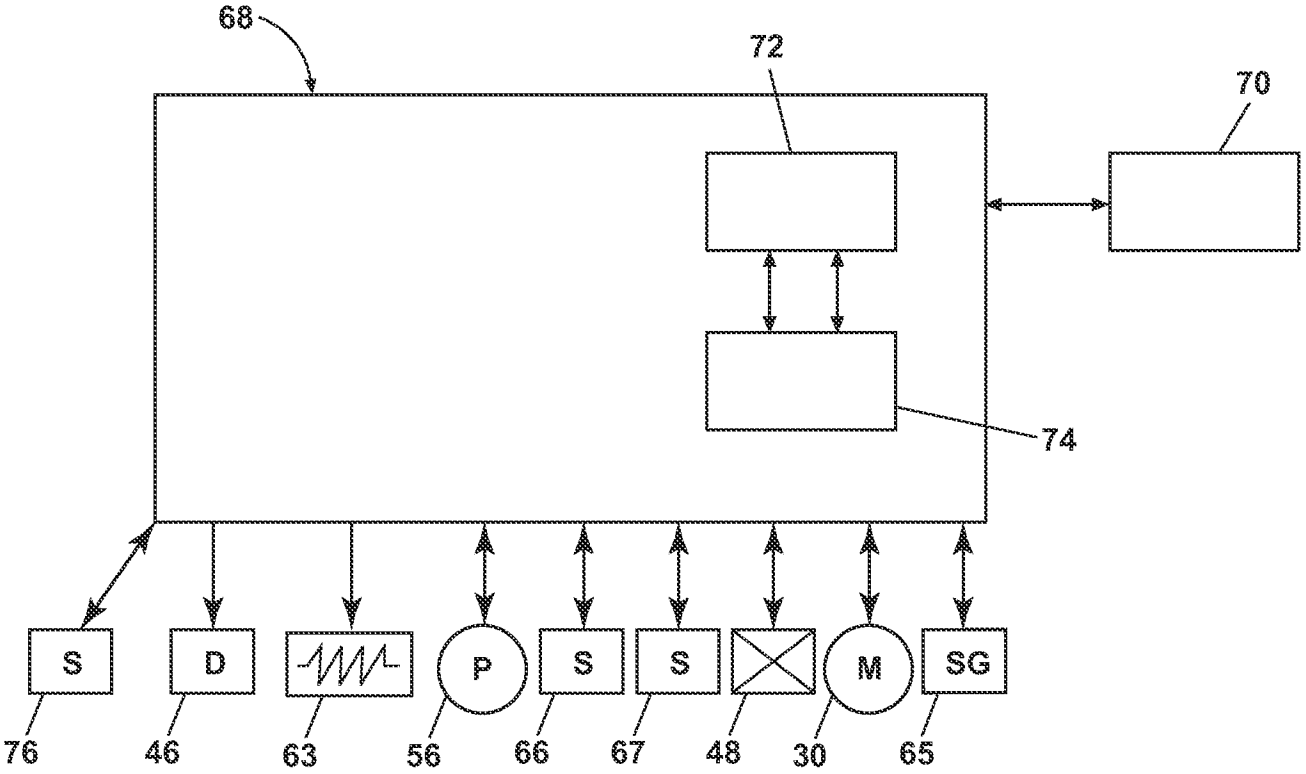
FIG. 2 is a schematic view of a controller of the washing machine of FIG. 1.

As illustrated in FIG. 2, the controller 68 may be provided with a memory 72 and a central processing unit (CPU) 74. The memory 72 may be used for storing the control software in the form of executable instructions that may be executed by the CPU 74 in executing one or more cycles of operation using the washing machine 10 and any additional software. The memory 72 may also be used to store information, such as a database or table, and to store data received from one or more components of the washing machine 10 that may be communicably coupled with the controller 68 as needed to execute the cycle of operation.

The controller 68 may be operably coupled with one or more components of the washing machine 10 for communicating with and controlling the operation of the component to complete a cycle of operation. For example, the controller 68 may be operably coupled with the motor 30 to provide a motor control signal to rotate the drum 18 according to a speed profile for the at least one cycle of operation, for controlling at least one of the direction, rotational speed, acceleration, deceleration, torque and power consumption of the motor 30. For example, the speed profile may have at least a constant speed phase, where the drum 18 may be rotated at a constant speed, and an acceleration phase, where the drum 18 may be accelerated to the constant speed. The memory 72 of the controller 68 may store an acceleration rate for the acceleration phase and the motor control signal may accelerate the drum 18 according to the acceleration rate during the acceleration phase.

The controller 68 may be operably coupled with the treating chemistry dispenser 46 for dispensing a treating chemistry during a cycle of operation. The controller 68 may be coupled with the steam generator 65 and the sump heater 63 to heat the liquid as required by the controller 68. The controller 68 may also be coupled with the pump 56 and inlet valve 48 for controlling the flow of liquid during a cycle of operation. The controller 68 may also receive input from one or more sensors 76, which are known in the art. Non-limiting examples of sensors that may be communicably coupled with the controller 68 include: a treating chamber temperature sensor, a moisture sensor, a drum position sensor, a motor speed sensor 66, a motor torque sensor 67, a level sensor, etc. The controller 68 may also be operably coupled with the user interface 70 for receiving user selected inputs and communicating information with the user.

The motor speed sensor 66 and the motor torque sensor 67 are shown integrated with the motor 30 and in communication with the controller 68. Alternatively, the sensors 66 and 67 may be independent of the motor 30 and may be in communication with the controller 68. The motor torque sensor 67 may include a motor controller or similar data output on the motor 30 that provides data communication with the motor 30 and outputs motor characteristic information such as oscillations, generally in the form of an analog or digital signal, to the controller 68 that may be indicative of the applied torque. The controller 68 may use the motor characteristic information to determine the torque applied by the motor 30 using a computer program that may be stored in the controller memory 72. Specifically, the motor torque sensor 67 may be any suitable sensor, such as a voltage or current sensor, for outputting a current or voltage signal indicative of the current or voltage supplied to the motor 30 to determine the torque applied by the motor 30. Additionally, the motor torque sensor 67 may be a physical sensor or may be integrated with the motor 30 and combined with the capability of the controller 68, may function as a sensor. For example, motor characteristics, such as speed, current, voltage, direction, torque etc., may be processed such that the data provides information in the same manner as a separate physical sensor. In contemporary motors, the motors 30 often have their own controller that outputs data for such information.

When the drum 18 with the laundry load rotates during an extraction phase, the distributed mass of the laundry load about the interior of the drum is a part of the inertia of the rotating system of the drum and laundry load, along with other rotating components of the appliance. The inertia of the rotating components of the appliance without the laundry is generally known and can be easily tested for. Thus, the inertia of the laundry load can be determined by determining the total inertia of the combined load inertia the appliance inertia, and then subtracting the known appliance inertia. In many cases, as the total inertia is proportional to the load inertia, it is not necessary to distinguish between the appliance inertia and the load inertia.

The total inertia can be determined from the torque necessary to rotate the drum. Generally, the motor torque for rotating the drum 18 with the laundry load may be represented in the following way:

$$\tau = J^*\dot{\omega} + B^*\omega + C \quad (1)$$

where, $\tau$=torque, J=inertia, $\dot{\omega}$=acceleration, $\omega$=rotational speed, B=viscous damping coefficient, and C=equals Coulomb friction.

Figure 3:
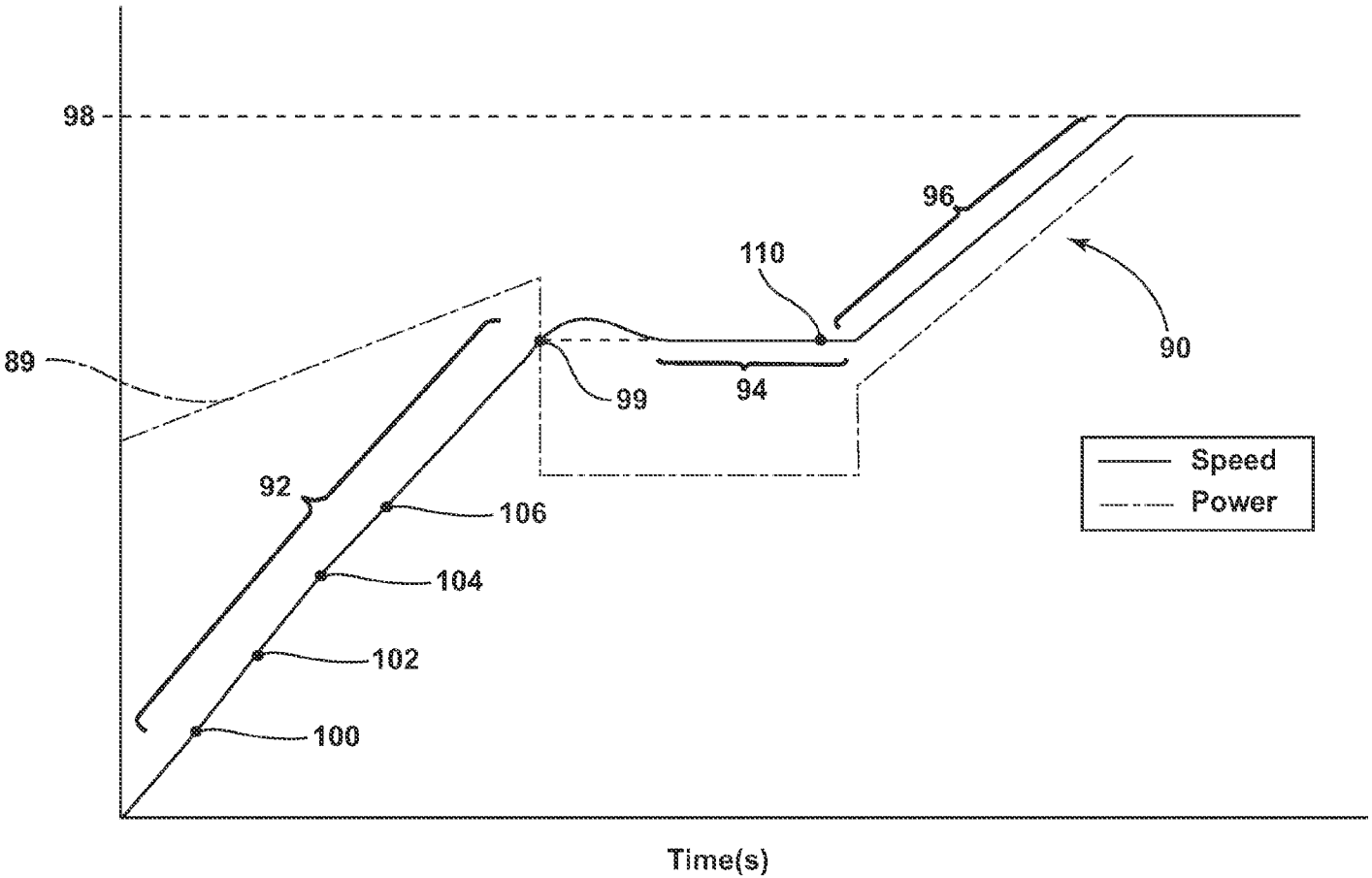
FIG. 3 is a schematic plot of rotational speed of the drum with time during a speed profile having two acceleration ramps interposed by a constant speed plateau and where the inertia of the load is determined during the second ramp.

Traditionally, the inertia of the laundry load may be determined during an extraction phase having at least one plateau phase followed by a ramp phase. FIG. 3 illustrates such a prior speed profile 90 that may be used during an extraction phase. For example, the speed profile 90 during the extraction phase may be configured to include at least two accelerations or ramps 92 and 96 and one constant speed phase 94, which is illustrated in the form of a plateau in-between the two accelerations 92 and 96. The constant speed phase 94 immediately follows the acceleration phase 92 to define a pairing of a ramp and a plateau. While only one pairing is illustrated, it is contemplated that the speed profile may include multiple pairings of acceleration phases and constant speed phases. In such an instance, each pairing may have a different constant speed. During the acceleration phase 92 and the acceleration phase 96, the motor 30 may be controlled in any suitable manner including that the rate of acceleration may be predetermined and may be constant.

It will be understood that the constant speed phase 94 may not immediately transition from the acceleration phase 92 to the constant speed phase 94 without going past the speed of the constant speed phase 94 due to the controls on the motor 30. In most cases, a closed loop PI or PID controller may be used, which permit some overshoot of the motor speed when transitioning between the ramp and the plateau.

A power profile 89 of power versus time has been superimposed on the speed profile 90. The power profile 89 illustrates that the power may decrease during the acceleration phase 92 when the ramp has a fixed acceleration rate because typically liquid is being extracted at a rate faster than the product of B$\omega$ increases with increasing speed, resulting in less power being needed to maintain the fixed rate of acceleration. During the transition from the ramp to constant speed phase 94, the power drops almost instantaneously from the level required to maintain the acceleration ramp. Conversely, the power jumps almost instantaneously at the start of the acceleration phase 96 and then steadily declines as liquid is extracted.

For purposes of this disclosure, unless expressly stated otherwise, power and torque are interchangeable as they are proportional to each other as provided by the relationship: Power=$\tau^*\omega$. In most contemporary motors, at least one, if not both, of the power and torque are outputted directly from the motor controller, making it easy to continuously obtain the values for motor and/or torque. As the math is typically simpler when looking at the torque relationships, instead of the power relationships, the mathematical relationships will be discussed in terms of torque, with it being understood that it applies equally as well to power.

Historically, to determine the inertia, it was necessary to have a plateau followed by a ramp in order to determine the viscous damping B. During the plateau, the rotational speed may be maintained to be constant, and the resulting acceleration ($\dot{\omega}$) may be zero. Then, from equation (1), the torque may be expressed only in terms of B*$\omega$ in the following way:

$$\tau = B^*\omega + C \quad (2)$$

The Coulomb friction is often ignored because of its relatively small magnitude and/or because it cancels out when the torque equations on the ramp and plateau are set equal to each other. Then, during the constant speed phase, equation (2) may be solved for the viscous damping coefficient as the torque and rotational speed are known. Ignoring the Coulomb friction and rearranging the variables, we have $$\tau/\omega = B \quad (3)$$

Real-time values indicative of torque and rotational speed are typically available with most laundry treating appliances, both of which are typically outputted from a controller for the motor and/or sensed by dedicated sensors. Thus, B may be easily calculated during a plateau.

Then, once B is known, it may be possible to determine the inertia by accelerating the drum during the second acceleration 96. During such acceleration, inertia may be solved for in equation (1) with the acceleration being known during the second acceleration 96. The acceleration may be normally defined by the ramp or sensed. For example, most ramps are accomplished by providing an acceleration rate to the motor. This acceleration rate may be used for the acceleration in the equation.

While the inertia may be determined in this manner, the length of time required to make the calculations and the inability to determine the inertia until the second acceleration 96 increases the time period to reach some desired extraction speed 98, and correspondingly the entire time period for the extraction phase may be longer than, resulting in increased cycle time, which is undesirable for most user.

Embodiments of the invention address the problem of unnecessarily long cycle times caused by the inability of current methods to quickly determine the inertia, especially being able to determine the inertia during a plateau, without needing to wait until the subsequent ramp. The subsequent ramp is needed in contemporary calculations as it is impossible to simultaneously accelerate through a given speed and stay at that speed at the same time.

The embodiments of the invention are able to determine the inertia upon transitioning to the plateau and do not need to wait until a subsequent ramp. The embodiments of the invention are further able to make the inertia determination without having to determine B, and even without determining acceleration or rotational speed, for that matter. The embodiments of the invention need only determine the difference in the power (or torque as mentioned above) of the motor at the end of the ramp and during the plateau, preferably at the point where the ramp transitions to the plateau, which may be referred to as a "knee" of the profile, where the rotational speed of the ramp and plateau are the same.

While conceptually it is simple to say that one only needs the difference in the power of the ramp and plateau at the knee to determine the inertia, it is not simple in practice because motor controllers do not provide for an instantaneous and a perfect transition from the ramp to the plateau. As previously mentioned, the controller cannot simultaneously accelerate through the plateau speed corresponding to the knee, as required by the ramp, while holding the speed constant at the plateau speed for the knee.

The embodiments of the invention address the problem by projecting the power at the plateau speed for the ramp, which negates the need to continue the ramp up to the plateau speed. The ramp may be terminated prior to the plateau, with the speed coming to the plateau speed. The projecting of the power at the plateau speed can be done by estimating the power at the plateau speed for the ramp based on actual power data, along the ramp to the plateau. The actual power data may be used in applying a curve fit method, such as any type of regression, to determine the power at the plateau speed. In this manner, the regression may be made on power readings while the speed is increasing and does not require that the profile pass through the same point twice to make the determination.

This approach is further beneficial in that the difference in the power at the plateau speed for the ramp and plateau is directly related to the inertia of the laundry load. As the power is readily available as a motor output, the difference can be determined with only the need to project the power at the plateau speed for the ramp. A look at the controlling equations governing the relationship will show how the inertia is a function of the difference in the power. For simplicity, the torque equations, instead of power equations, will be used:

During the ramp, the torque is represented by equation (4) below:

$$\tau_{ramp}=J\dot{\omega}+B\omega+C \tag{4}$$

During the plateau, since there is no acceleration, the torque is represented by equation (5) below:

$$\tau_{plateau}=B\omega+C \tag{5}$$

Subtracting $\tau_{plateau}$ from $\tau_{ramp}$ yields equation (6):

$$\tau_{ramp}-\tau_{plateau}=J\dot{\omega}+B\omega+C-B\omega-C \tag{6}$$

Upon the cancelling of terms and the rearrangement of equation (6) to solve for inertia, it can be seen in equation (7) below that the inertia is proportional to the difference in the ramp and plateau torques at the plateau speed.

$$\frac{\tau_{ramp}-\tau_{plateau}}{\dot{\omega}}=J \tag{7}$$

As $\tau_{plateau}$ is directly outputted by the motor controller, and $\dot{\omega}$ is known as a set acceleration rate or can easily be sensed, then $\tau_{ramp}$ need only be determined, such as by regression to have the necessary information to determine the inertia of the load.

With this methodology, it is the plateau and the preceding ramp, not the plateau and the subsequent ramp that are required to determine the inertia, which provides for a much earlier determination of the inertia.

Figure 4:
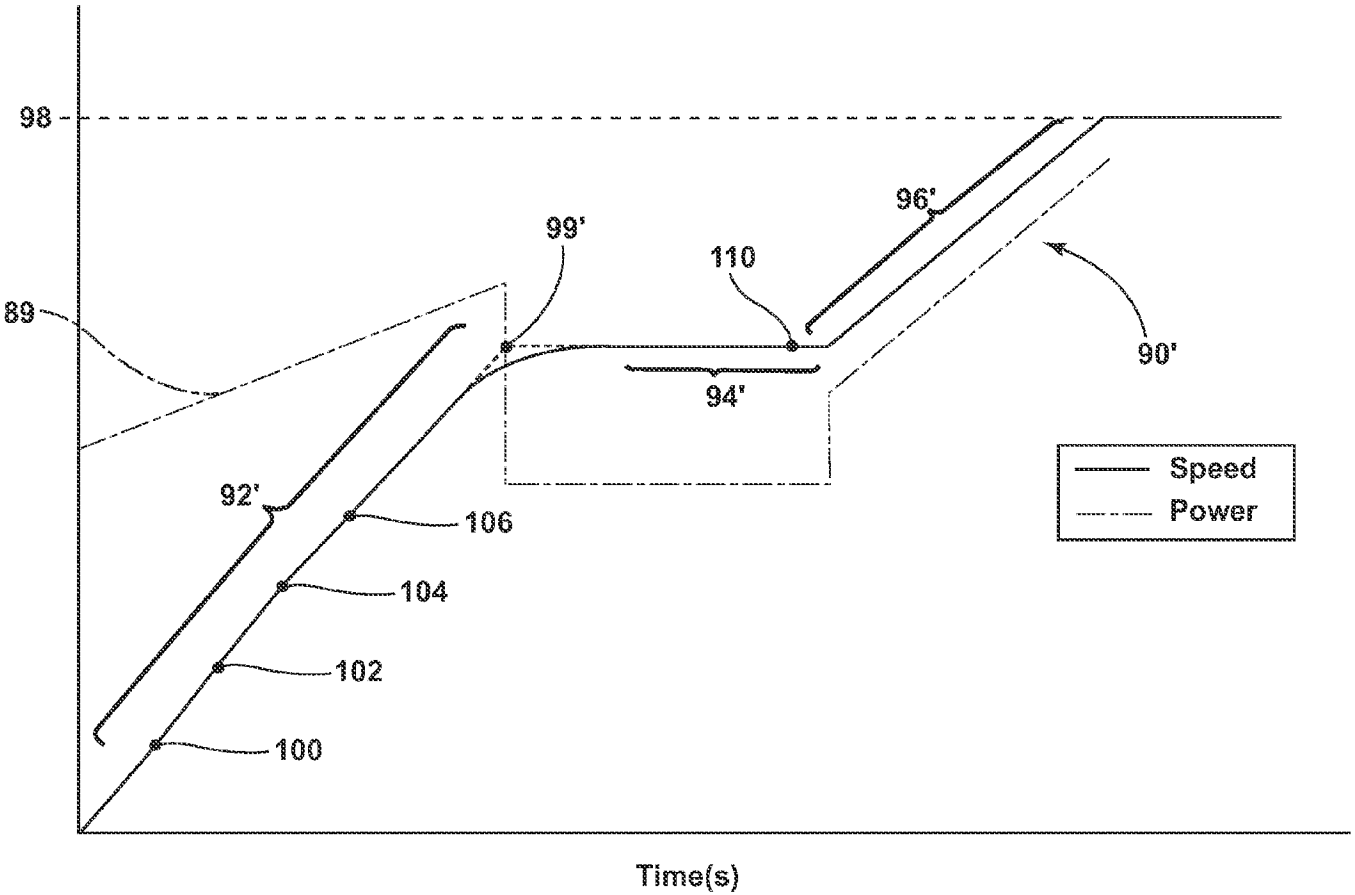
FIG. 4 is a schematic plot of rotational speed of the drum with a speed profile having two acceleration ramps interposed by a constant speed plateau and where the inertia of the load is determined during the plateau.

With this background, reference is made to FIG. 4, which may be used to illustrate the embodiments of the invention. The profile 90' of FIG. 4 is similar to FIG. 3 in that there are two ramps 92' and 96', with an intervening plateau 94'. The theoretical junction, the knee, of the ramp 92' and the plateau 94' is defined by point 99'. However, in reality, contemporary controllers cannot make the immediate transition. Thus, the actual speed profile is selected so that the speed departs from the ramp 92' and transitions to the plateau 94', with minimal to no overshoot, to minimize the time to transition between the ramp 92' and the plateau 94'. However, for purposes of the invention, it is acceptable that overshoot occurs because the benefit of the invention is determining the inertia before the subsequent ramp 96'. Thus, the transition from the ramp 92' to the plateau 94' is not relevant, other than the faster the transition, the shorter the cycle time, which is beneficial to the consumer.

According to embodiments of the invention, to determine the inertia, the controller 68 may monitor the power provided to the motor 30 during the acceleration phase 92'. Monitoring the power includes monitoring at least one parameter of the motor indicative of the power. For example, the parameter may include torque, rotational speed, voltage, and current of the motor. Monitoring the power may include repeatedly determining, such as by sensing or receiving an output from the motor controller, the power during the acceleration phase 92 such as at points 100, 102, 104, and 106.

Although, the actual motor speed deviates from the ramp 92' prior to reaching the knee point 98, the controller 68 may then calculate the power that would have been provided to the motor 30 at the knee point 98, had the rotational speed been accelerated through the knee point 98, based on the power data collected at points 100-106. The controller 68 may apply a curve-fit algorithm to the power data points 100, 102, 104, and 106 to project what the power would have been at the knee point 98. Any suitable curve-fitting method may be used including a regression algorithm such as a linear regression algorithm. In this manner, the power at the knee point 99 may be determined from a curve resulting from the curve fit algorithm. The calculated value of the power at point 98 may then be stored in a memory of the controller.

The power provided to the motor 30 during the constant speed phase 94 may then be determined, at any point along the plateau, such as at the point 110. For the sake of reduced cycle time, the power may be determined sooner than later. The determination of the power during the plateau may be determined in any number of suitable ways. In many cases, the motor controller will output one or more parameters having values indicative of the power, such as one or more of torque, rotational speed, voltage, and current of the motor.

Inertia of the laundry load may then be determined based on the calculated power at point 99 and the determined power at the point 110. More specifically, determining the inertia may include determining a difference between the calculated power and the determined power, and using the difference to determine the inertia. In determining the difference, it is not necessary to actually calculate the inertia. As the difference in the power is proportional to the inertia by the acceleration, it is only necessary to determine the difference and not actually divide the difference by the acceleration as shown by equation (7). This is especially true if the difference is always determined at the same plateau speed. Under such circumstances, one need only have reference values for the difference at the predetermined plateau speed.

If desired, the inertia may be fully calculated by the controller solving equation (7). The acceleration may be known, such as in a set acceleration rate as an input to the motor controller, or may be determined, such as by sensing, estimating, or calculating, and used as an input by the controller.

It is contemplated that in the above explanation that calculating the power and determining the power may include indirectly calculating the power and determining the power. For example, calculating the power and determining the power may include calculating the torque and determining the torque. More specifically, because power and torque are proportional, torque may be used instead of power to determine the inertia. For example, the controller 68 may quickly determine the inertia by repeatedly determining the torque during the acceleration phase 96, calculating the torque at the constant speed from the repeated determinations of the torque, determining the torque during the constant speed phase, and determining the quotient of the difference between the calculated torque and the determined torque divided by the acceleration rate.

Once the inertia is determined, a final speed such as the desired extraction speed 98 of drum 18 with the laundry may be calculated from equation (1) and any potential damage for the drum 18 may be prevented. The invention described herein provides a method to determine the inertia based on the required power to accomplish a given acceleration rate at a given speed without actually accelerating through that speed. This allows for inertia of the laundry load to be determined sooner than with conventional methods and with less acceleration phases. One advantage that may be realized in the practice of some embodiments of the described apparatus and method is that the spin time may be reduced, which will reduce the overall cycle time. This results in enhanced customer satisfaction. Reducing the spin time has the added effect of reducing power consumption, since components of the appliance such as motors, etc. will operate for a shorter period of time.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method of operation of a laundry treating appliance having a rotatable drum at least partially defining a treating chamber in which a laundry load is received for treatment, and a motor rotatably driving the drum in response to a control signal, the method comprising:

rotating the drum with the motor according to a speed profile having at least a constant speed phase, where the drum is rotated at a constant speed, and an acceleration phase, where the drum is accelerated to the constant speed;

monitoring power provided to the motor during the acceleration phase;

calculating power to be provided to the motor for the constant speed based on the monitored power during the acceleration phase;

determining the power provided to the motor during the constant speed phase; and determining an inertia of the laundry load based on a difference between the calculated power and the determined power.

2. The method of claim 1 wherein the constant speed phase immediately follows the acceleration phase to define a pairing.

3. The method of claim 2 wherein the speed profile comprises multiple pairings of acceleration phases and constant speed phases.

4. The method of claim 3 wherein each pairing has a different constant speed.

5. The method of claim 1 wherein monitoring the power comprises monitoring at least one parameter of the motor indicative of the power.

6. The method of claim 5 wherein the at least one parameter comprises torque, rotational speed, voltage, or current of the motor.

7. The method of claim 1 wherein monitoring the power comprises repeatedly determining the power during the acceleration phase.

8. The method of claim 7 wherein calculating power to be provided to the motor for the constant speed comprises applying a curve-fit algorithm to the repeated determinations of the power.

9. The method of claim 8 wherein the curve-fit algorithm comprises a regression algorithm.

10. The method of claim 9 wherein the regression algorithm is a linear regression algorithm.

11. The method of claim 8 wherein calculating the power comprises determining the power at the constant speed from a curve resulting from the curve-fit algorithm.

12. The method of claim 1 wherein calculating power to be provided to the motor for the constant speed comprises applying a curve-fit algorithm to the monitored power.

13. The method of claim 12 wherein calculating the power comprises determining the power at the constant speed from the curve resulting from the curve-fit algorithm.

14. The method of claim 1 wherein determining the power comprises determining at least one parameter of the motor indicative of the power.

15. The method of claim 14 wherein the at least one parameter comprises torque, rotational speed, voltage, or current of the motor.

16. The method of claim 1 wherein determining the inertia further comprises determining a quotient of the difference divided by a rate of acceleration during the acceleration phase.

17. The method of claim 16 wherein the rate of acceleration is predetermined.

18. The method of claim 17 wherein the rate of acceleration is constant.

19. The method of claim 1 wherein calculating the power and determining the power comprise indirectly calculating the power and determining the power.

20. The method of claim 19 wherein calculating the power and determining the power comprise calculating a torque and determining a torque.

* * * * *